US005701943A

United States Patent [19]

Young

[11] Patent Number: 5,701,943

[45] Date of Patent: Dec. 30, 1997

[54] MANUFACTURE OF COMPOSITE MATERIALS

[75] Inventor: Robin Michael Kurt Young, Wantage, United Kingdom

[73] Assignee: AEA Technology PLC, Didcot, United Kingdom

[21] Appl. No.: 587,706

[22] Filed: Jan. 19, 1996

[30] Foreign Application Priority Data

Jan. 27, 1995 [GB] United Kingdom ..... 9501645

[51] Int. Cl.[6] ..... B22D 19/14; B22D 18/02

[52] U.S. Cl. ..... 164/97; 114/98; 114/120

[58] Field of Search ..... 164/97, 120, 900, 164/98

[56] References Cited

U.S. PATENT DOCUMENTS

| | | | |
|---|---|---|---|
| 3,877,884 | 4/1975 | Tawarada | 29/182.5 |
| 4,431,605 | 2/1984 | Lueth | 419/26 |
| 4,575,449 | 3/1986 | Lueth | 419/26 |
| 4,591,481 | 5/1986 | Lueth | 419/26 |
| 4,735,656 | 4/1988 | Schaefer | 75/238 |
| 4,836,978 | 6/1989 | Watanabe | 419/10 |
| 5,023,145 | 6/1991 | Lomax | 428/614 |
| 5,114,469 | 5/1992 | Weiman | 75/235 |
| 5,200,003 | 4/1993 | Rohatgi | 146/514 |
| 5,333,667 | 8/1994 | Louar et al. | 164/97 |
| 5,551,997 | 9/1996 | Marder et al. | 164/900 |

FOREIGN PATENT DOCUMENTS

| | | | |
|---|---|---|---|
| 0240251 | 10/1987 | European Pat. Off. . | |
| 0282191 | 9/1988 | European Pat. Off. . | |
| 0368789 | 5/1990 | European Pat. Off. . | |
| 22 52 797 | 5/1973 | Germany . | |
| 60-21306 | 2/1985 | Japan | 164/97 |
| 459854 | 1/1937 | United Kingdom . | |
| 2123439 | 2/1984 | United Kingdom . | |
| WO 90/02620 | 3/1990 | WIPO . | |
| WO 92/16325 | 10/1992 | WIPO . | |

*Primary Examiner*—Joseph J. Hail, III
*Assistant Examiner*—I. H. Lin
*Attorney, Agent, or Firm*—William R. Hinds

[57] ABSTRACT

Metal matrix composite is made by blending non-metal reinforcement powder with powder of metal or metal alloy matrix material, heating to a temperature high enough to cause melting of the matrix metal/alloy and subjecting the mixture to high pressure in a die press before solidification occurs.

5 Claims, 1 Drawing Sheet

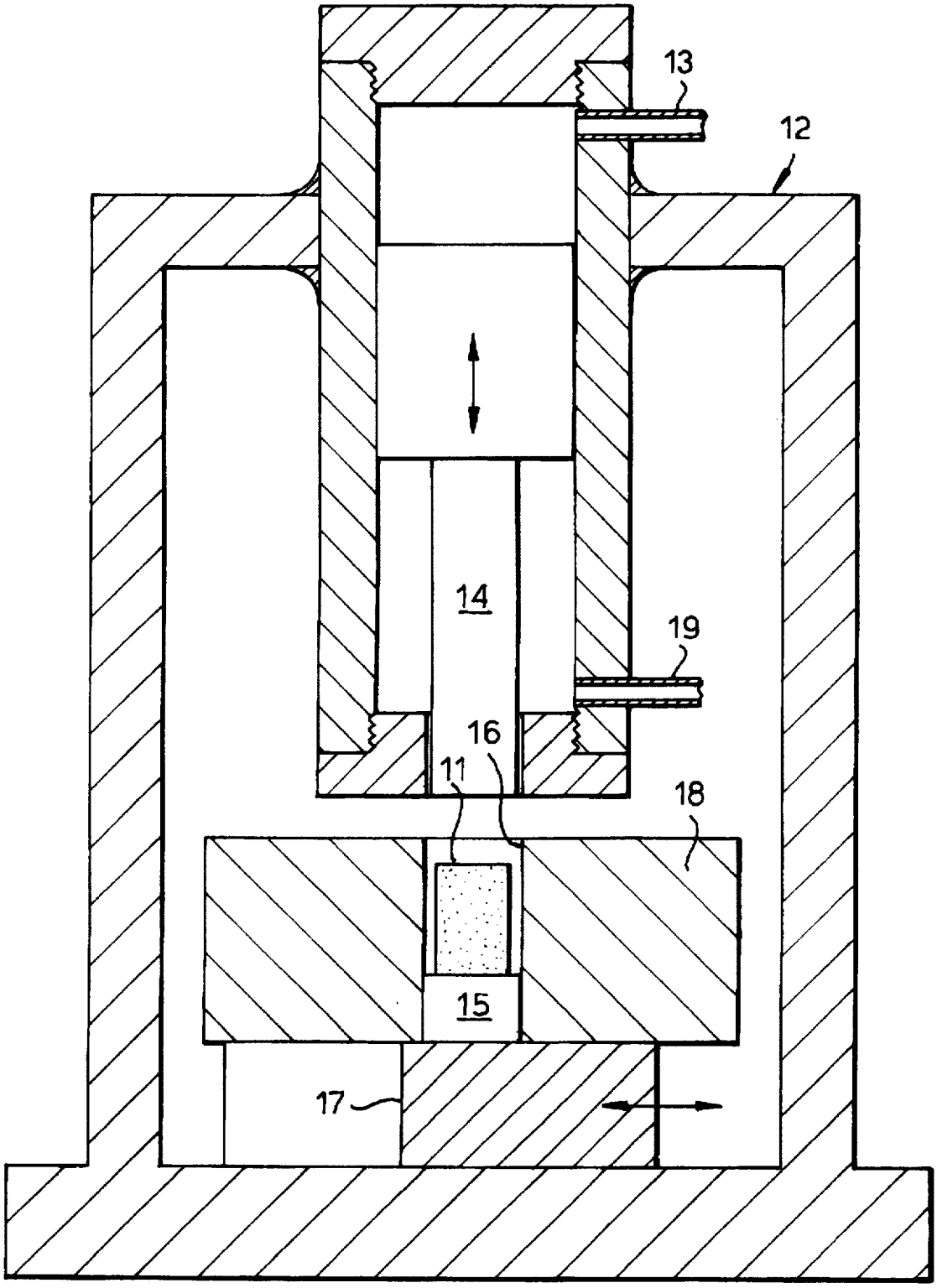
13
12
14
19
16
11
18
15
17

MANUFACTURE OF COMPOSITE MATERIALS

FIELD OF THE INVENTION

The invention relates to the manufacture of composite materials and more specifically to a method for manufacturing such materials comprising a metal or metal alloy matrix reinforced with particulate non-metal, preferably ceramic reinforcement.

DESCRIPTION OF THE RELATED ART

A number of processes have been developed for the manufacture of metal matrix composites, in which, for example, particulate reinforcement is stirred into liquid metal matrix material; or porous pre-forms of the reinforcement are made and molten metal matrix introduced by infiltration, with or without prior evacuation and/or subsequent application of pressure; or finely divided solid state mixtures of metal matrix material and reinforcement material have been subjected to pressure within massive die presses to form a product artefact by solid state fusion of the particles in the mixture.

The choice of process depends upon the application, infiltration being most generally adopted where complex shapes are to be formed and/or a high proportion of reinforcement is desired. Whichever process is adopted, the problems of achieving effective mass production at an acceptably low cost are difficult to overcome. It is particularly desirable, but difficult, to achieve net shape casting so as to avoid the time consuming and expensive step of machining the metal matrix composite to its required final dimensions.

For simple shapes, such as can be produced in a massive die press, the solid state route mentioned above can be satisfactory. Both the matrix metal and the reinforcement have to be provided in particulate form and a massive die press is required. Nevertheless, the raw material is available at relatively low cost and the capital cost and maintenance cost of the die press can be offset by the relative simplicity and speed with which artefacts can be produced. A drawback is, however, that by this route the maximum proportion of reinforcement that can be incorporated is about 40 volume percent.

The present invention is a development of this method by which metal matrix composite products with higher volume fractions of reinforcement and properties comparable with or better than those produced by gas pressure assisted infiltration, can be produced.

According to the present invention in one aspect there is provided a method of manufacturing a composite artefact comprising the steps of:

i) forming a mixture in which particles of metal or metal alloy matrix material are inter-dispersed with particles of ceramic reinforcement material, the relative proportion of matrix and reinforcement corresponding to that desired in the finished composite artefact, and the volume percentage of reinforcement material being greater than 40, ii) heating the mixture to a temperature high enough to cause melting of the metal matrix material, iii) applying pressure in excess of 15,000 psi to the heated mixture in a die-press whereby sufficient shear and pressure forces are exerted upon the constituents to cause a substantial proportion of the molten metal particles to coalesce into a continuous matrix in which the particles of reinforcement are embedded, and iv) after a period of time of not more than several minutes when the matrix material has solidified, removing the solid artefact from the die.

Where the matrix material has a melting point, e.g. in a metal matrix material, the temperature for step (ii) is above the melting point. However, where the matrix material is a metal alloy which softens and melts over a temperature range, the temperature of step (ii) can be such as to cause sufficient melting for the coalescence referred to in step (iii) to take place. In practice it may be desirable for the temperature to be raised high enough in step (ii) for the alloy matrix material to be fully melted.

No particular shape is implied by the use herein of the term particles except that in any one particle no one dimension greatly exceeds another. The use of a fibrous reinforcement is not excluded, but would be used in a form in which the fibres are chopped to short lengths. In the method of the invention we prefer that the reinforcement is non-metal and preferably a ceramic.

It is convenient to pre-heat the die before introducing the heated mixture into the die. It is necessary to ensure that the metal matrix material remains molten for long enough to apply pressure and achieve the disruption of the discrete globules (corresponding to the particles in the starting material) of liquid metal matrix material required for step iii) above. There is a trade-off, in that, if the die is cold, the mixture can be heated to a temperature appropriately higher than the melting point of the metal matrix material. However, it will generally be more economical to pre-heat the die.

We have found that the method works well with a pressure applied in the die of 200 Mega Pascals (Mpa) (30,000 psi approx). In principle the higher the pressure the better will be the result. We anticipate that, nevertheless the method will work at lower die pressures, e.g. possibly as low as 100 Mpa (15,000 psi approx).

The non-isostatic stresses created by the uniaxial compaction effected by die pressing assist in the method of the invention and in step (iii) above in particular.

The invention includes an artefact made by the aforesaid method.

BRIEF DESCRIPTION OF THE DRAWING

The single drawing FIGURE is a diagrammatic sectional representation of an hydraulic die press.

A specific method and artefact embodying the invention will now be described by way of example and with reference to the accompanying drawing in FIG. 1 which is a diagrammatic sectional representation of an hydraulic die press, within which is a container filled with metal matrix composite constituents.

In this example, silicon carbide powder comprising a blend of different grades to provide a desired packed volume fraction is blended with commercial purity aluminium or 2014 aluminium alloy powder to give the required volume fraction of silicon carbide reinforcement in the product composite. For example a blend of 60–70 volume percent 240 grade silicon carbide particles and correspondingly 40–30 volume percent 600 grade particles gives a maximum packed volume fraction of silicon carbide. This was blended with the metal or metal alloy powder of particle size corresponding to the average particle size of the silicon carbide to yield a product volume fraction in three demonstration experiments of 70, 65 and 60 volume percent respectively.

A thin walled steel can 11 was filled with the blended powders lightly compacted. The steel can 11 was pre-heated, before introduction into the hydraulic die press 12, in a muffle furnace to 800° C. under argon gas to limit oxidation.

The steel can was then transferred to the bore 16 in block 18 of a 500 ton hydraulic press 12. Pressure of 200 MPa (30,000 psi approx) was then applied via hydraulic line 13 and piston 14 and held for several minutes. The press 12 was pre-heated sufficiently to ensure that there was no solidification of the molten globules of the metal or metal alloy matrix material until after full pressure had been reached.

For ease of removal of the solidified billet, the press 12 employed was a modified extrusion press with a solid die plate 15 received in the bottom of the bore 16 of the block 18. The die plate 15 and the block 18 are supported against the applied pressure by a horseshoe shaped slidable block 17. An hydraulic mechanism (not shown) is used to move the sliding block 17 laterally so that the die plate 15 and compacted billet are ejected into the space between the arms of the sliding block 17, whilst the latter continues to provide support for block 18. The piston 14 is then returned by releasing the hydraulic pressure from line 13 and applying an hydraulic return pressure via line 19.

It will be appreciated that plates, cylinders, rings and other simple shapes are readily formed by appropriate modification of the press or by using inserts.

Tests carried out on samples machined from the product billet showed that the hardness (both before and after ageing) and density were generally comparable with composites of similar composition formed by gas pressure assisted infiltration. The density of products formed by the high pressure liquid compaction method of the example embodying the invention was somewhat less than achieved by infiltration at the higher (65 volume percent, 70 volume percent) volume fractions of reinforcement.

Metallographic examination showed an even distribution of large and small particulates within the metal or metal alloy matrix, no identifiable particle boundaries or silicon carbide free zones, and no discernable formation of interfacial carbide phases.

Tensile testing and fracture energy and toughness testing showed the high pressure liquid compaction composite to have higher tensile strength and fracture toughness than corresponding gas pressure assisted infiltration product. Elastic modulus measurements showed generally similar values for composites made by high pressure liquid compaction to those made by gas assisted infiltration.

The composite products of the high pressure liquid compaction method have application to brake discs. In addition to the recognised advantages of metal matrix composites in their wear resistance, lightweight, and thermal conductivity, high volume fraction composites have the further advantages of lower levels of thermally induced stresses and hence reduced susceptibility to thermal fatigue cracking.

Further potential applications are in tooling for processing plastics materials, substrates for optics devices and detectors.

The invention is not restricted to the details of the foregoing examples. For instance, whilst having particular application for the manufacture of composites with a matrix of aluminium metal or aluminium alloy, especially aluminium silicon alloy, the method may be used with silver metal or silver alloys, copper, bronze or even brass powders if higher melting point matrix material is required. Ceramic particulates other than silicon carbide can be used, such as, for example, boron carbide, titanium diboride, alumina, silicon nitride, or sialons.

The heating need not necessarily be carried out under argon gas but may be carried out under any suitable gas which does not react with the constituents at the temperatures to which they are heated. Or, the heating may be carried out under vacuum.

The particle size of the matrix metal or metal alloy need not necessarily correspond with the average particle size of the reinforcement material. Finer metal or metal alloy particles may be used. Indeed, coarser metal or metal alloy particles may be used, but there is a limit.

The method will also work with reinforcement particles of a single mean particle size if desired, although, as indicated above, to achieve high volume fraction of reinforcement, a blend of different particle sizes is preferred.

The mixture of matrix metal or metal alloy powder and particular reinforcement may, if desired, be pressed into a brickette prior to heat treatment to melt the matrix.

I claim:

1. A method of manufacturing a composite artefact comprising the steps of:

i) forming a mixture in which particles of metal or metal alloy matrix material are inter-dispersed with particles of ceramic reinforcement material, the relative proportion of matrix and reinforcement corresponding to that desired in the finished composite artefact, and the volume percentage of reinforcement material being greater than 40, ii) heating the mixture to a temperature high enough to cause melting of the metal matrix material, iii) applying pressure in excess of 15,000 psi to the heated mixture in a die-press whereby sufficient shear and pressure forces are exerted upon the constituents to cause a substantial proportion of the molten metal particles to coalesce into a continuous matrix in which the particles of reinforcement are embedded, and iv) after a period of time of not more than several minutes when the matrix material has solidified, removing the solid artefact from the die.

2. A method as claimed in claim 1 wherein the die is pre-heated.

3. A method as claimed in claim 1 wherein the pressure exerted in the die is at least 30,000 psi.

4. A method as claimed in claim 1 wherein the volume percentage of reinforcement material is at least 45.

5. A method as claimed in claim 1, wherein the volume percentage of reinforcement material is at least 60.

* * * * *